US009931855B2

(12) United States Patent
Fukui et al.

(10) Patent No.: US 9,931,855 B2
(45) Date of Patent: Apr. 3, 2018

(54) LIQUID STORAGE CONTAINER

(71) Applicant: CANON KABUSHIKI KAISHA, Tokyo (JP)

(72) Inventors: Shigeki Fukui, Kawasaki (JP); Masanori Kaneko, Kawasaki (JP); Keiichiro Tsukuda, Yokohama (JP); Yasuo Kotaki, Yokohama (JP); Tatsuo Nanjo, Kawasaki (JP); Masafumi Seki, Fukushima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/333,846

(22) Filed: Oct. 25, 2016

(65) Prior Publication Data

US 2017/0120610 A1 May 4, 2017

(30) Foreign Application Priority Data

Oct. 30, 2015 (JP) ..... 2015-214234

(51) Int. Cl.
*B41J 2/175* (2006.01)

(52) U.S. Cl.
CPC ..... *B41J 2/17523* (2013.01)

(58) Field of Classification Search
CPC ..... B41J 2/17536; B41J 2/1754
See application file for complete search history.

(56) References Cited

U.S. PATENT DOCUMENTS 6,416,152 B1 * 7/2002 Matsuzaki ..... B41J 2/17503 347/19
2007/0263034 A1 * 11/2007 Yoshihira ..... B41J 2/17536 347/47
2010/0315472 A1 * 12/2010 Anderson, Jr. ..... B41J 2/17533 347/86

FOREIGN PATENT DOCUMENTS

JP 2003154675 A 5/2003

* cited by examiner

*Primary Examiner* — Geoffrey Mruk
*Assistant Examiner* — Scott A Richmond
(74) *Attorney, Agent, or Firm* — Canon U.S.A., Inc. IP Division

(57) ABSTRACT

A liquid storage container for storing a liquid has a label member attached to a surface thereof. A bonding face of the label member that is bonded to the surface includes a first area and a second area having a low bonding strength. The second area covers a liquid supply port. A score line is formed on the label member, and the score line extends along a boundary between the first area and the second area and is formed in the second area.

20 Claims, 17 Drawing Sheets

LIQUID STORAGE CONTAINER

BACKGROUND OF THE INVENTION

Field of the Invention

The present invention relates to a liquid storage container.

Description of the Related Art

In a liquid discharge apparatus equipped with a liquid discharging head that discharges a liquid such as ink, a tube supply method is known as a method of supplying the liquid to the liquid discharging head. The tube supply method is a method in which a main tank and the liquid discharging head are connected with a tube and a liquid contained in the main tank is supplied to a liquid storage container of the liquid discharging head via the tube.

The liquid storage container of the liquid discharging head using the tube supply method includes a liquid supply port that is detachably connected to the tube. As disclosed in Japanese Patent Laid-Open No. 2003-154675, a label member is attached so as to cover the liquid supply port in order to suppress a leak of the liquid from the liquid supply port and evaporation of the liquid.

SUMMARY OF THE INVENTION

A liquid storage container according to an embodiment of the present invention is a liquid storage container for storing a liquid having a label member attached to a surface thereof. A bonding face of the label member that is bonded to the surface includes a first area and a second area having a bonding strength lower than a bonding strength of the first area when the first area and the second area are bonded to the surface. The second area of the label member covers a liquid supply port that opens through the surface and through which the liquid is supplied to an inside of the liquid storage container. A score line is formed on the label member, and the score line extends along a boundary between the first area and the second area and is formed in the second area.

Further features and aspects of the present invention will become apparent from the following description of various embodiments with reference to the attached drawings.

DESCRIPTION OF THE EMBODIMENTS

It is thought that, when a liquid storage container (liquid discharging head) is used, a liquid supply port is exposed in a manner in which one part of a label member is detached while the other part remains. For example, information about the liquid storage container is described on the remaining part. In the case of a liquid discharge apparatus to which a plurality of the liquid storage containers can be mounted, the information enables a user to know a proper mounting position of each liquid storage container, enabling suppression of a failure of mounting.

As disclosed in Japanese Patent Laid-Open No. 2003-154675, the liquid storage container to which the label member is attached is required to maintain a state where the label member is not detached and covers the liquid supply port even when a vibration or an impact is created during distribution. When one part of the label member is detached, for example, in use of the liquid storage container, the liquid storage container is also required to maintain a state where the other part on which information about the liquid storage container is described remains securely attached. Accordingly, the label member is preferably bonded to the liquid storage container as firmly as possible. In this case, however, a sufficient load to detach the label member is increased, and it is difficult to readily detach the label member.

The present invention provides a liquid storage container that enables one part of the attached label member to be readily detached and enables the other part to remain successfully attached.

Various embodiments, features and aspects of the present invention will hereinafter be described with reference to the drawings.

First Embodiment

Figure 1:
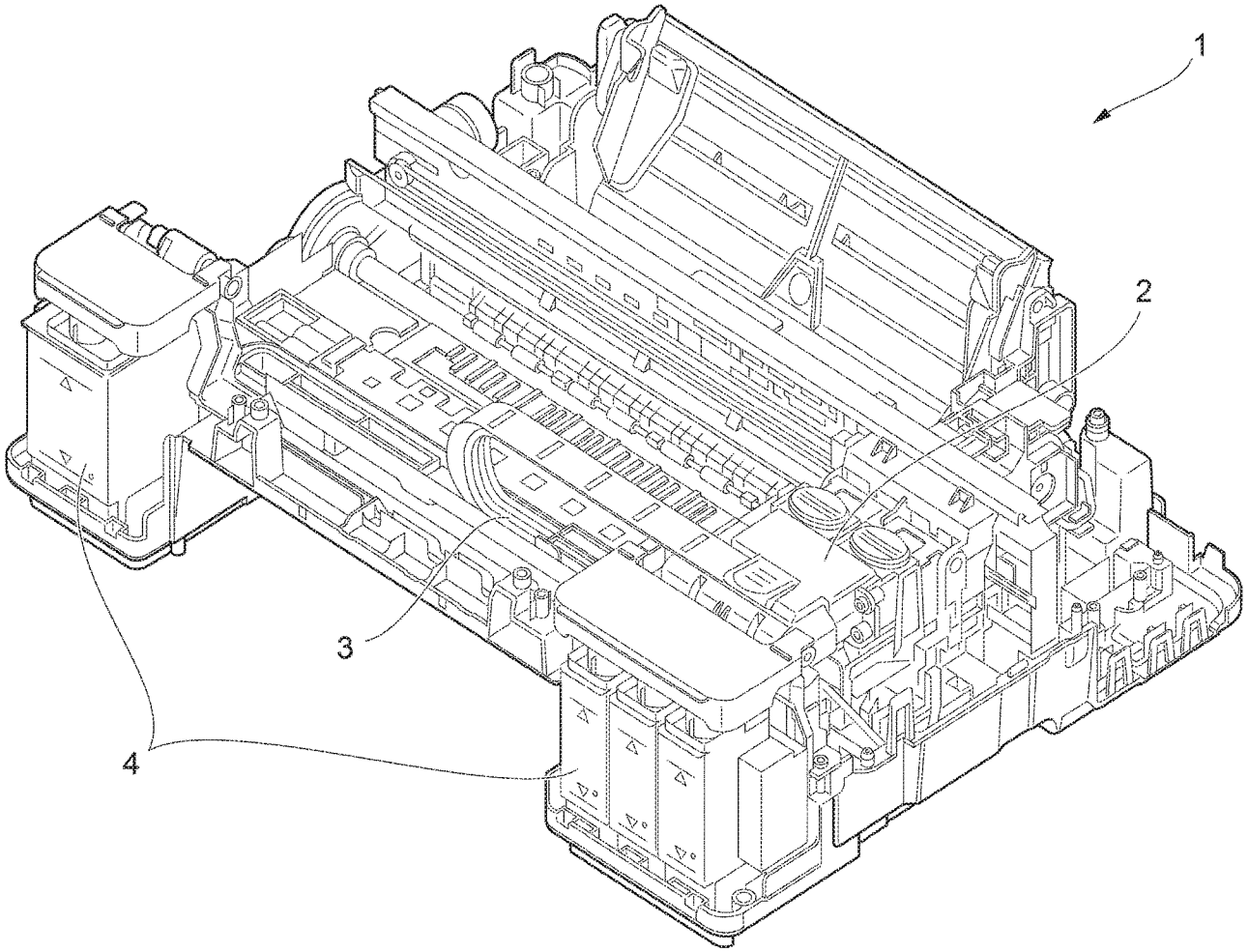
FIG. 1 is a perspective view of a liquid discharge apparatus.

FIG. 1 is a perspective view of a liquid discharge apparatus according to a first embodiment of the present invention.

A liquid discharge apparatus 1 includes a carriage 2, a tube 3 (flexible member), and a main tank 4 (liquid reservoir). A joint (not illustrated) is disposed at an upper portion of the carriage 2. A liquid discharging head (not illustrated) is connected to the joint and can thereby be mounted to the carriage 2. The tube 3 is connected at an end thereof to the joint of the carriage 2 and is connected at the other end thereof to the main tank 4. When the liquid discharging head is mounted to the carriage 2, the liquid discharging head communicates with the main tank 4 via the joint and the tube 3.

Figure 2:
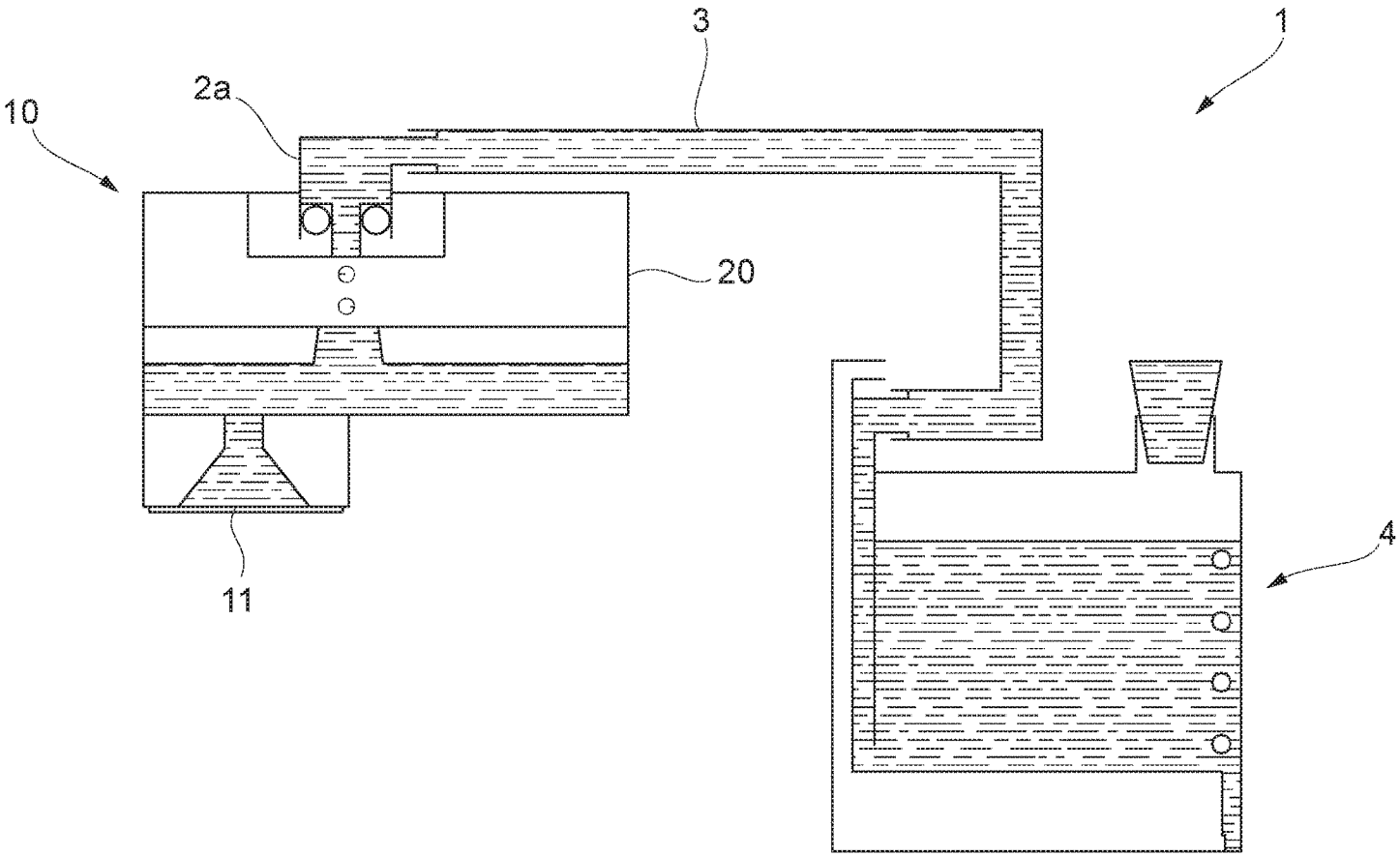
FIG. 2 is a schematic diagram illustrating the configuration of the liquid discharge apparatus.

FIG. 2 is a schematic diagram illustrating the configuration of the liquid discharge apparatus according to the first embodiment when the liquid discharging head is mounted to the carriage.

A liquid discharging head 10 includes a print element substrate 11 as a liquid discharge portion via which a liquid is discharged, and a liquid storage container 20 as a liquid storage portion that storages the liquid. Here, the print element substrate 11 is formed integrally with the liquid storage container 20. The liquid discharging head 10 is connected to a joint 2*a* of the carriage 2 and is connected to the main tank 4 in a state where the tube 3 connected to the joint 2*a* is interposed therebetween. The main tank 4 storages the liquid to be supplied to the liquid discharging head 10 and is in communication with the atmosphere. Accordingly, in the liquid discharging head 10, air is introduced into the main tank 4 in response to an increase in a negative pressure in the liquid storage container 20 when the liquid is discharged via the print element substrate 11. When air is introduced, the liquid in the main tank 4 is supplied to the liquid storage container 20 via the tube 3 and the joint 2*a*. Thus, the liquid in the main tank 4 can be continuously supplied to the liquid storage container 20 while an image is printed by the liquid discharging head 10.

Figure 3:
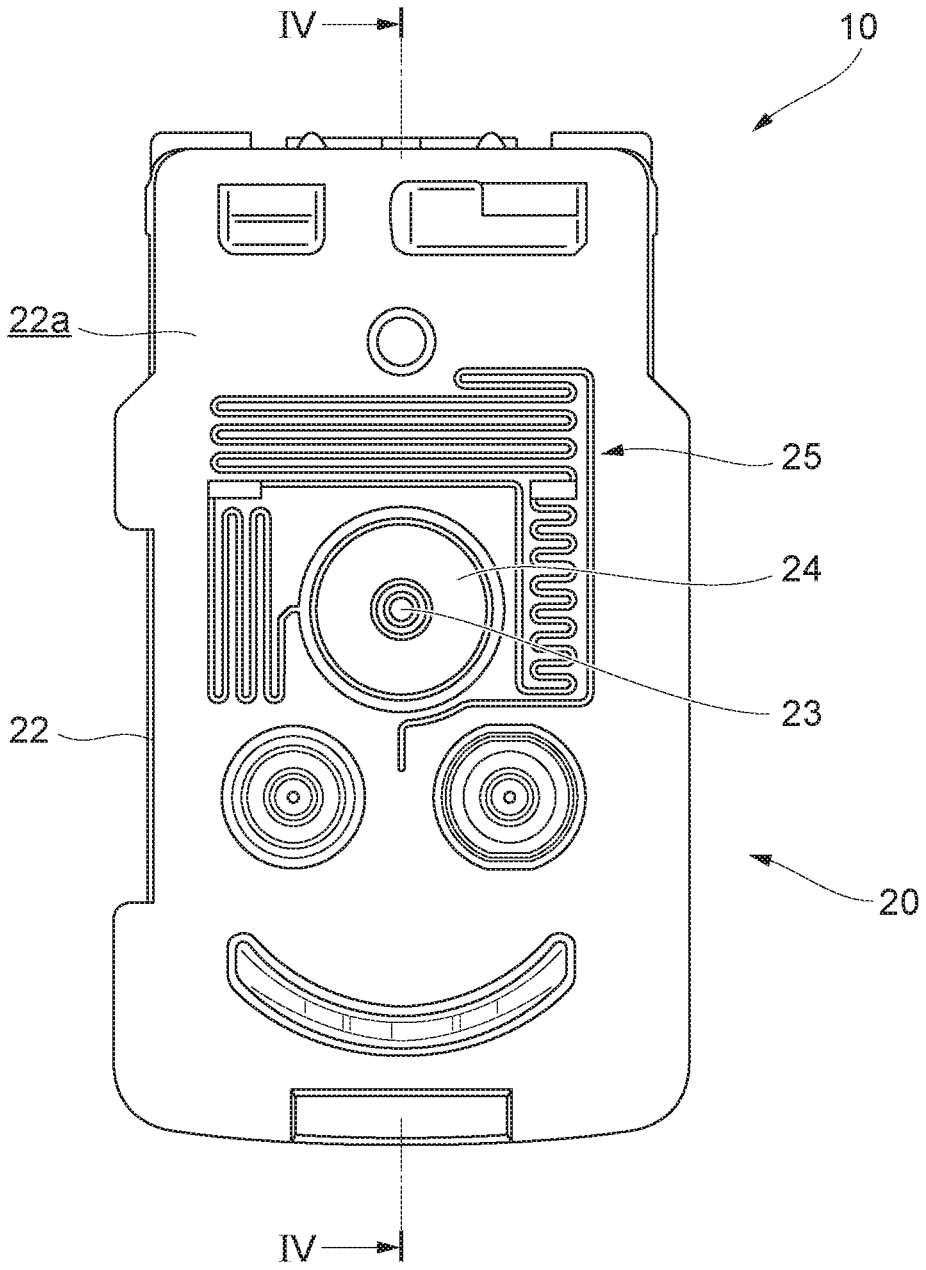
FIG. 3 is a top view of a liquid storage container.
Figure 4:
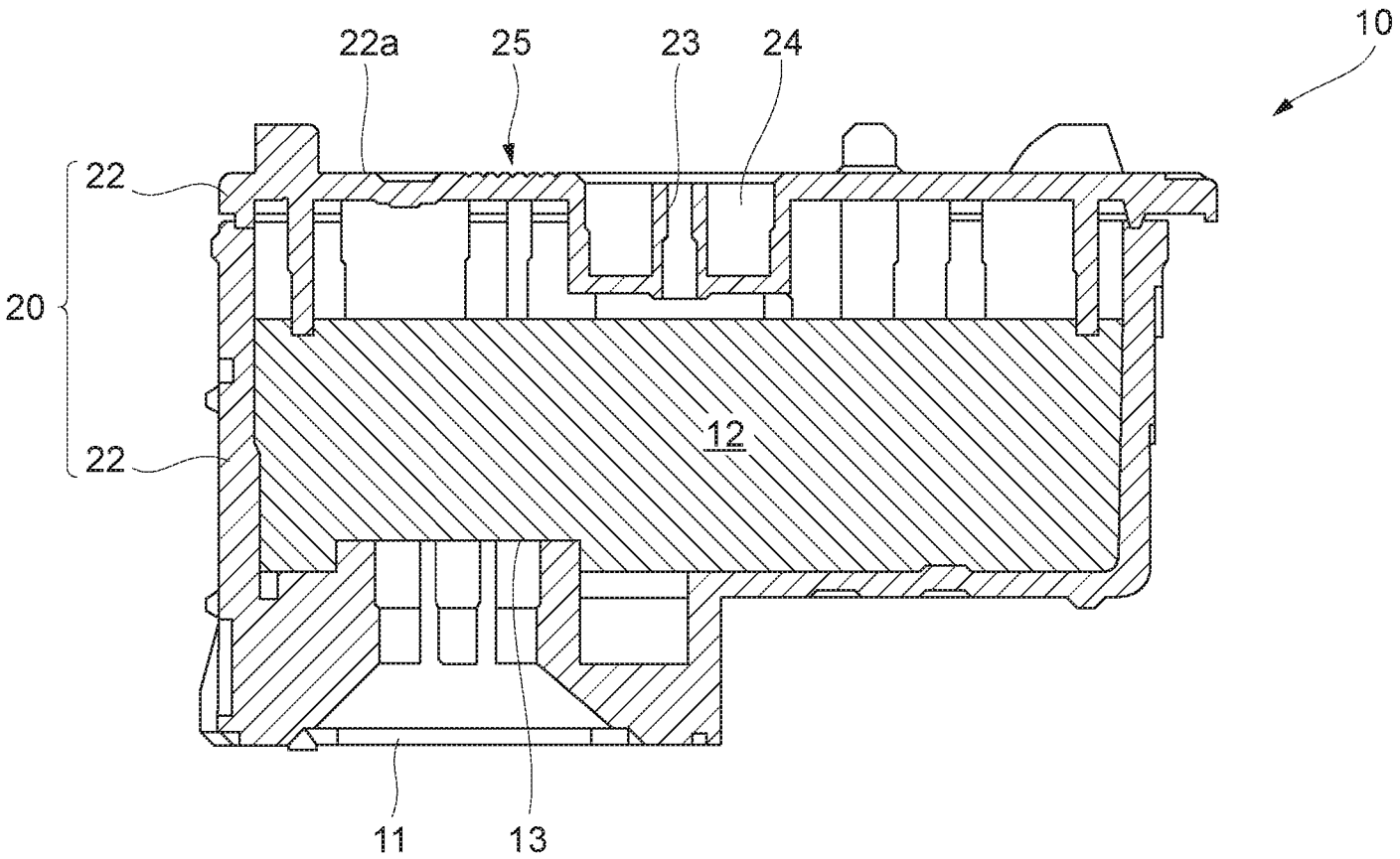
FIG. 4 is a sectional view of the liquid storage container taken along line IV-IV in FIG. 3.

FIG. 3 is a top view of the liquid storage container of the liquid discharging head according to the first embodiment. FIG. 4 is a sectional view of the liquid storage container taken along line IV-IV in FIG. 3.

The liquid discharging head 10 includes a case 21 and a lid 22 constituting the liquid storage container 20, an absorbent 12, and a filter 13. The case 21 is formed in a box shape. The lid 22 is welded to the circumference of an opening of the case 21 and closes the opening. The absorbent 12, which is made of a capillary tube and absorbs and holds a liquid, and the filter 13, which suppresses entrance of a foreign substance, such as dust, contained in the liquid into the print element substrate 11, are disposed in the inside of the liquid storage container 20 thus formed. An example of the absorbent 12 is a fiber absorbent. The print element substrate 11 is disposed at the lowest portion of the case 21 in the gravity direction when the liquid storage container is used.

A liquid supply port 23 is formed through the lid 22. The liquid supply port 23 opens through an upper surface 22*a*, which is a surface of the lid 22, and is detachably connected to the joint 2*a* in order to supply the liquid from the main tank 4 to the inside of the liquid storage container 20. A recessed portion 24 that receives the joint 2*a* of the carriage 2 is formed around the liquid supply port 23. A groove 25 extending from the recessed portion 24 so as to meander around the recessed portion 24 is formed on the upper surface of the lid 22. A portion of the upper surface 22*a* of the lid 22 at which the liquid supply port 23 opens is recessed from the other portion of the upper surface 22*a* (located at a lower position in the gravity direction when the liquid storage container is used).

Figure 5:
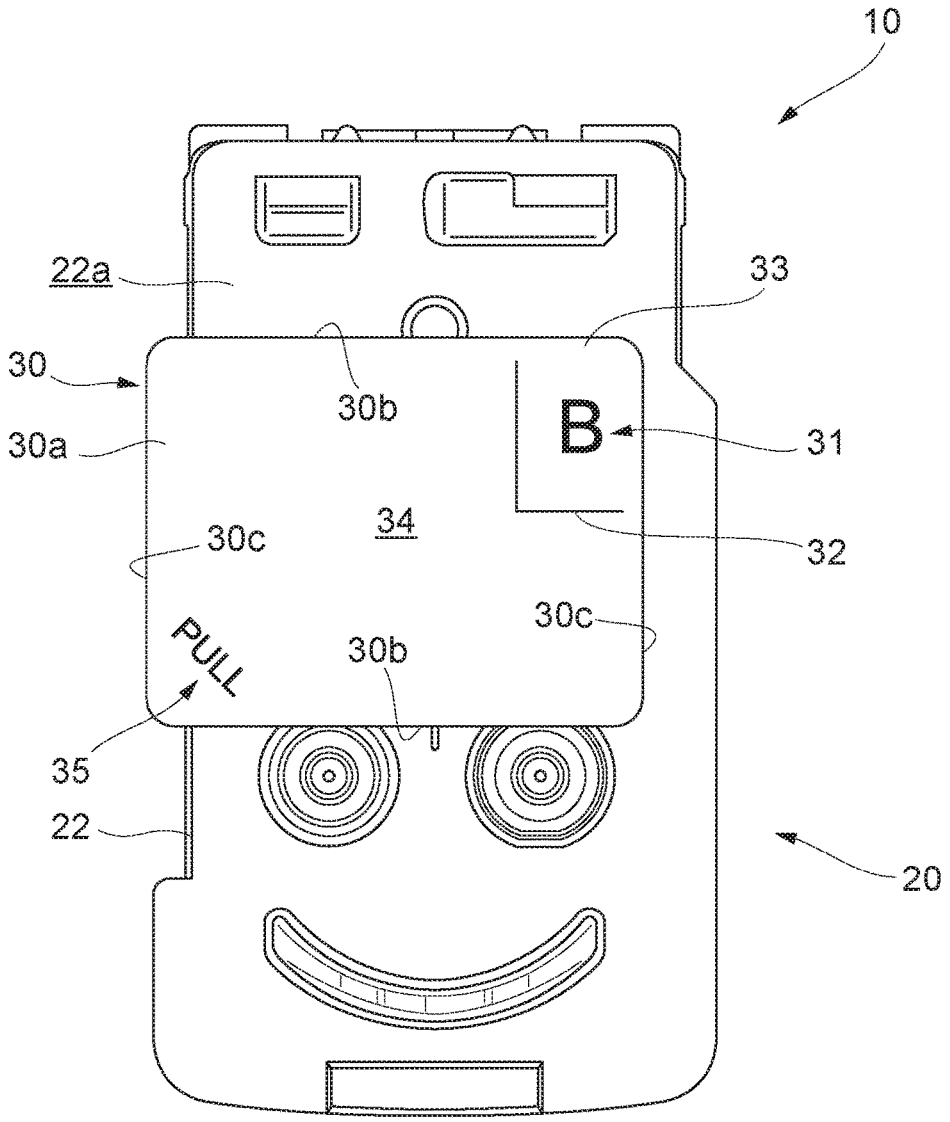
FIG. 5 is a top view of the liquid storage container.

FIG. 5 is a top view of the liquid storage container of the liquid discharging head according to the first embodiment during distribution.

A label member 30 on which information about the liquid storage container 20 is described is attached to the liquid storage container 20 of the liquid discharging head 10 during distribution. In the first embodiment, character information 31 of "B" indicating that the liquid contained in the liquid storage container 20 is black ink is described. A surface 30*a* of the label member 30 on which the character information 31 is described is referred to as an "information described surface" below.

The label member 30 is attached to a surface of the liquid storage container 20 (that is, the upper surface 22*a* of the lid 22) so as to cover the liquid supply port 23. The label member 30 can thus suppress a leak of the liquid from the liquid supply port 23 and evaporation of the liquid during distribution. The label member 30 is attached so as to cover the most part of the groove 25 other than an end of the groove 25. Since the portion at which the liquid supply port 23 opens is recessed from the other portion of the upper surface 22*a* as described above, a gap is left between that portion and the label member 30. Accordingly, the label member 30 and the groove 25 function as an air communication passage through which the inside of the liquid storage container 20 is in communication with the atmosphere, and the air communication passage enables an adjustment in the pressure of the inside of the liquid storage container 20, which varies depending on variations in the temperature around the liquid storage container 20 or variations in the atmospheric pressure.

The label member 30 is formed in a rectangular shape including two pairs of opposing side portions, that is, a pair of long side portions 30*b* and a pair of short side portions 30*c*. The character information 31 is described near a corner portion of the rectangle. The label member 30 is detached to expose the liquid supply port 23 when the liquid storage container 20 is used. At this time, a portion of the label member 30 near the corner portion on which the character information 31 is described remains attached to the liquid storage container 20, and the other portion other than the portion near the corner portion can be separated. Specifically, a score line 32 is formed on the label member 30 so as to surround the character information 31 in order to detach the other portion while causing the portion near the corner portion on which the character information 31 is described to remain. Thus, the character information 31 remaining on the liquid storage container 20 enables the liquid storage container 20 (the liquid discharging head 10) in use to be mounted at the proper position among possible mounting positions in the liquid discharge apparatus, enabling suppression of a failure of mounting. In the first embodiment, the score line 32 is formed of two lines to form the portion that remains on the liquid storage container 20 in a rectangular shape. Here, the score line 32 is formed in an L-shape. A portion 33 of the label member 30 that remains on the liquid storage container 20 is referred to as a "planned remainder portion", and a portion 34 that is detached is referred to as a "planned detachment portion".

In order to readily hold the label member 30 when the label member 30 is detached, the label member 30 is attached to the lid 22 such that one short side portion 30*c* opposite to the other short side portion 30*c* adjacent to the described character information 31 protrudes from an edge portion of the upper surface 22*a*. Character information 35 of "PULL" indicating a position at which the label member 30 begins to be detached is described near a corner portion diagonal to the corner portion on which the character information 31 is described.

The label member 30 is preferably attached to the lid 22 such that the planned remainder portion 33 is disposed on the upper surface 22*a* at a position at which parts of the groove 25 (see FIG. 3) are gathered. At the position at which parts of the groove 25 are gathered, the lid 22 is thin and the liquid in the liquid storage container 20 easily evaporates. Accordingly, in the case where such a portion continues to be covered by the planned remainder portion 33 after the liquid discharging head 10 is mounted to the liquid discharge apparatus 1, the evaporation of the liquid in the liquid storage container 20 can be suppressed.

Figure 6:
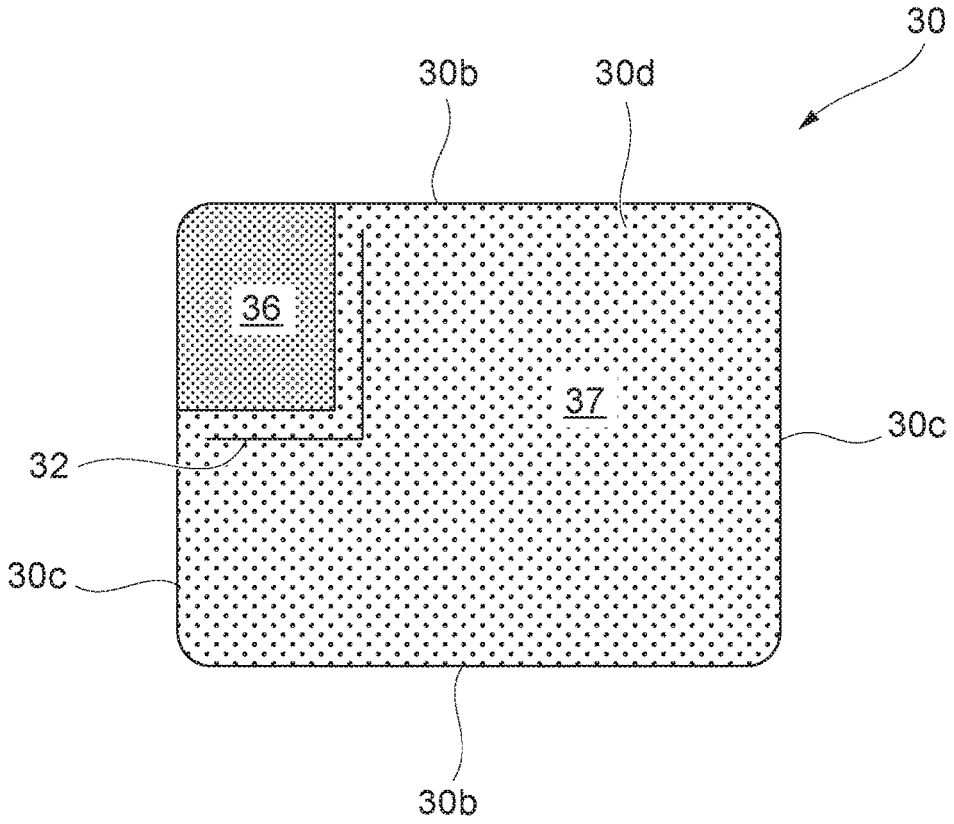
FIG. 6 is a plan view of a label member on the bonding face side.

FIG. 6 is a plan view of the label member according to the first embodiment on the bonding face side of the label member on which the liquid storage container is to be bonded.

The label member 30 includes, on the back side of the information described surface 30*a*, a bonding face 30*d* to be attached to the upper surface 22*a* of the lid 22. The bonding face 30*d* includes a first area 36 and a second area 37. The second area 37 covers the liquid supply port 23, through which the liquid is supplied to the inside of the liquid storage container 20, which opens through the surface of the liquid storage container 20. The second area 37 has a bonding strength lower than the bonding strength of the first area 36 when the first area 36 and the second area 37 are bonded to the surface of the liquid storage container 20. Accordingly, for example, an adhesive material (strong adhesive material) having a relatively high bonding strength is applied to the first area 36, and an adhesive material (weak adhesive material) having a bonding strength lower than the bonding strength of the adhesive material applied to the first area 36 is applied to the second area 37. The first area 36 is located inside an area surrounded by the score line 32, and the second area 37 is the other area other than the first area 36 located inside the surrounded area. The score line 32 extends along the boundary between the first area 36 and the second area 37. In other words, the score line 32 extends along the boundary between the first area 36 and the second area 37 and is formed in the second area 37. Accordingly, the bonding face 30*d* of the planned remainder portion 33 is composed of the first area 36 and one part of the second area 37, and the bonding face 30*d* of the planned detachment portion 34 is composed of the other part of the second area 37 only. The score line 32 is preferably formed at a position 1.0 mm to 2.0 mm (inclusive) away from the boundary between the first area 36 and the second area 37 and is formed, for example, at a position about 1.5 mm away from the boundary.

Figure 7:
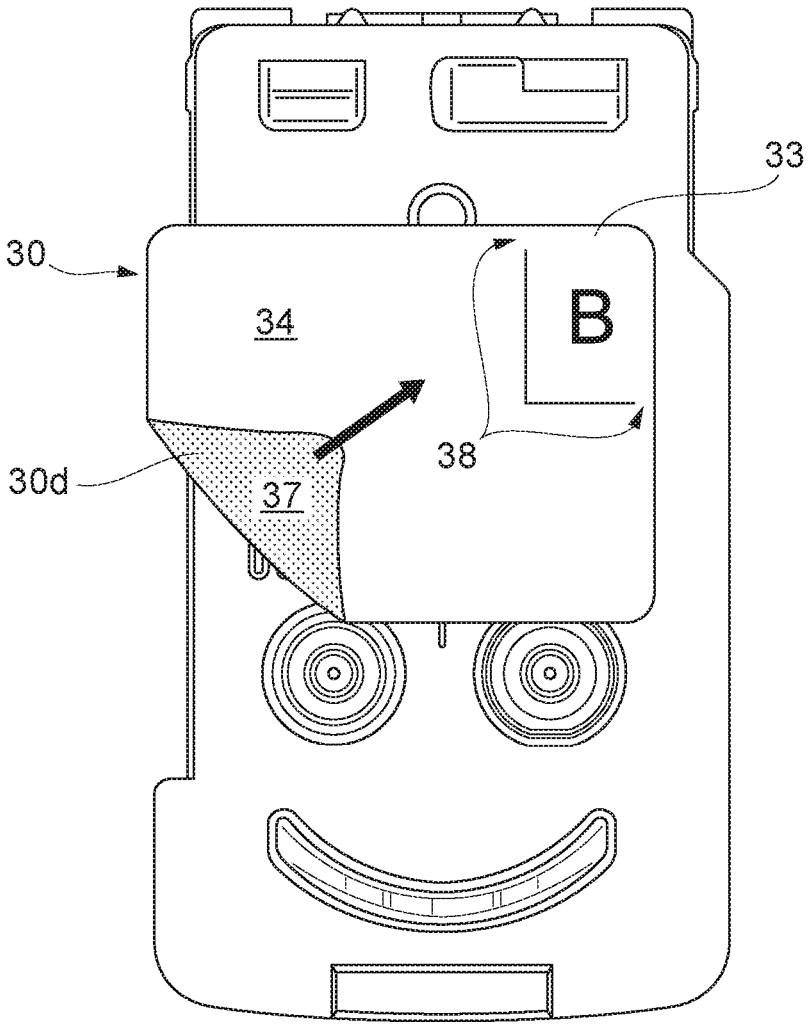
FIG. 7 is a top view of the liquid storage container in a state where a planned detachment portion begins to be detached.
Figure 8:
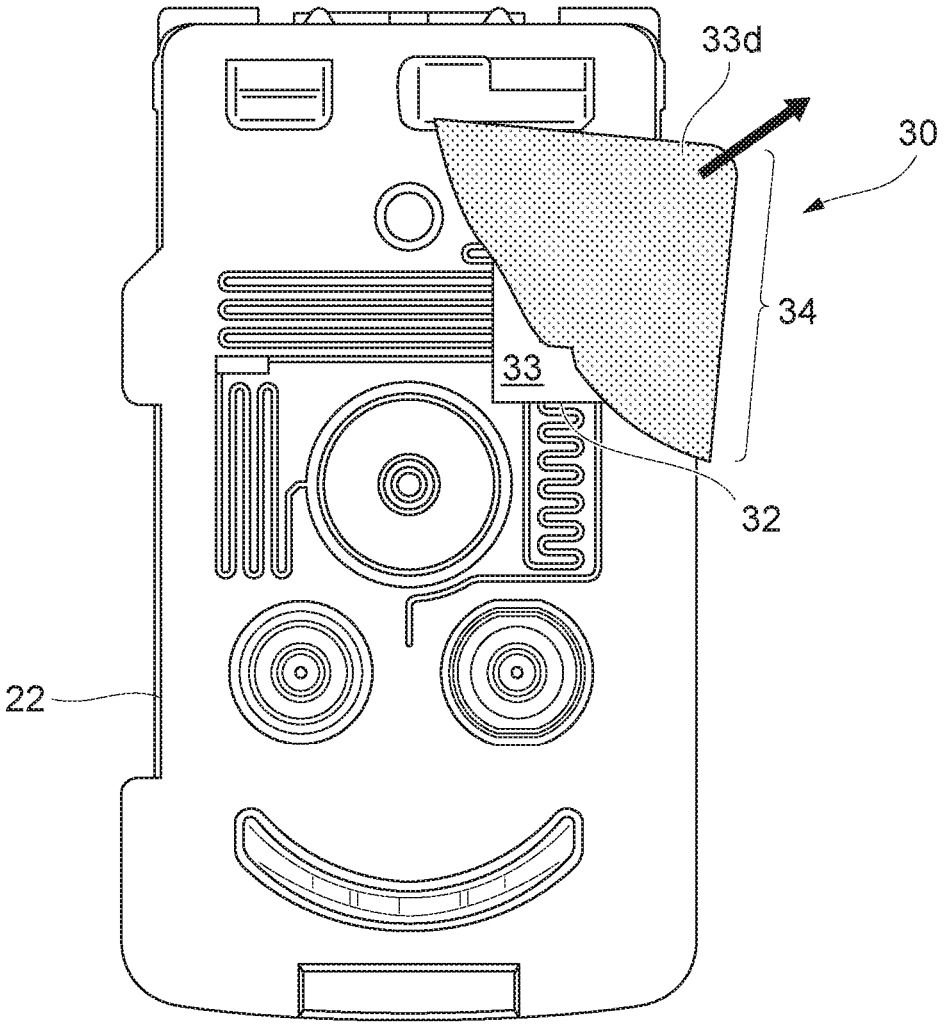
FIG. 8 is a top view of the liquid storage container in a state where the planned detachment portion is detached.
Figure 9:
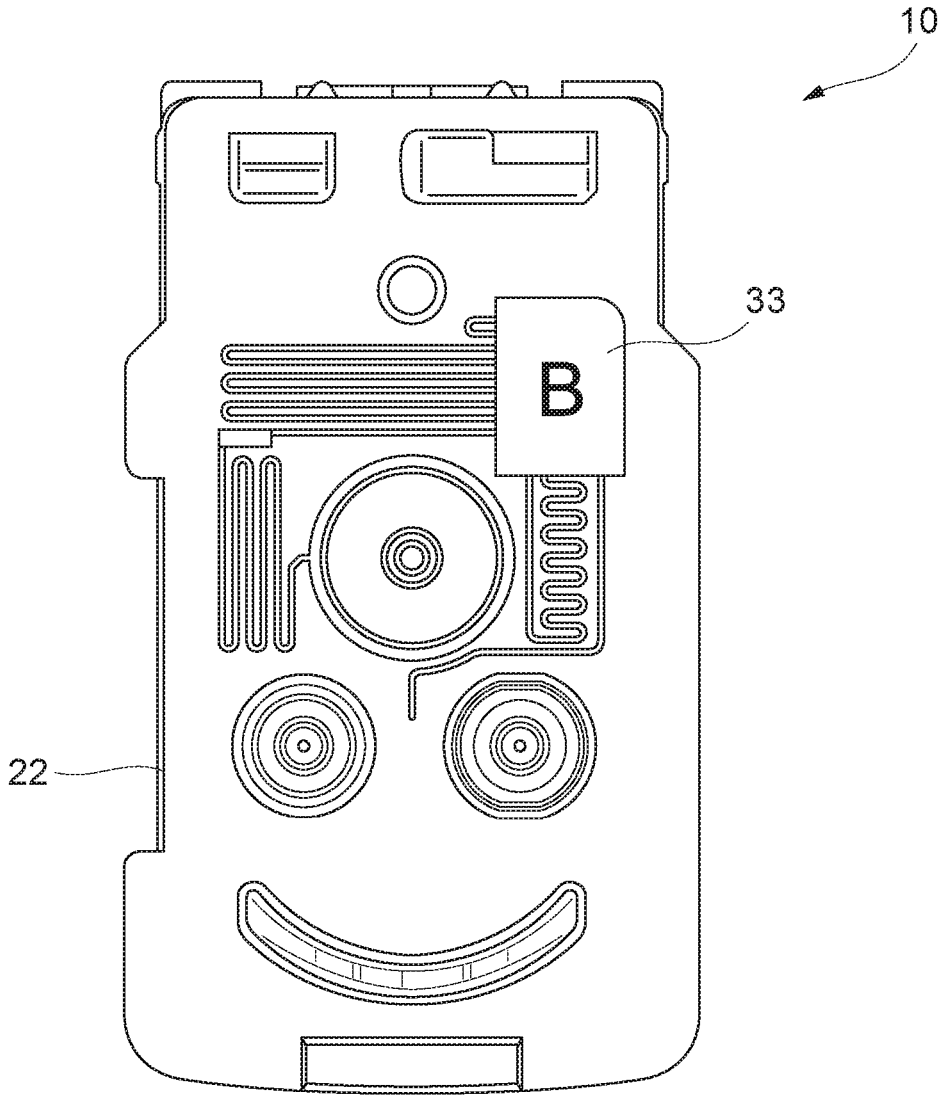
FIG. 9 is a top view of the liquid storage container after the planned detachment portion has been detached.

An operation of detaching the label member will now be described with reference to FIG. 7 to FIG. 9. FIG. 7 to FIG. 9 are top views of the liquid storage container according to the first embodiment that illustrate the process of detaching the label member by a user.

FIG. 7 illustrates a state where a user holds the portion near the corner portion on which the character information 35 is described, and the planned detachment portion 34 begins to be detached in the direction of an arrow in FIG. 7 toward the planned remainder portion 33. The bonding face 30*d* of the planned detachment portion 34 is the second area 37, and the bonding strength thereof is of such a degree that the planned detachment portion 34 is not detached due to a vibration or an impact during distribution but is readily detached by the detaching operation by a user. Accordingly, the planned detachment portion 34 can be readily detached and a high load is not required for the detachment. The load with which the second area 37 is detached is preferably no less than 1 N and no more than 3 N at the peak and is, for example, about 2 N.

FIG. 8 illustrates a state where the detachment of the planned detachment portion 34 in the direction of an arrow in FIG. 8 further proceeds from the state illustrated in FIG. 7. At this time, the planned detachment portion 34 is detached up to near the score line 32. In contrast, since the bonding face 30*d* of the planned remainder portion 33 includes the first area 36, the planned remainder portion 33 is not detached from the lid 22 and can remain attached successfully to the lid 22. The load with which the first area 36 is detached is preferably no less than 6 N and no more than 10 N at the peak and is, for example, about 8 N.

The score line 32 is located outside the first area 36, and the bonding face 30*d* of the planned detachment portion 34 does not include the first area 36, as described above. For example, in the case where the score line 32 is located inside the first area 36 and the bonding face 30*d* of the planned detachment portion 34 includes the first area 36, the planned detachment portion 34 may be broken starting from the included portion when detached and the broken portion may remain on the lid 22. In the first embodiment, however, the bonding face 30*d* of the planned detachment portion 34 does not include the first area 36, and accordingly, the planned detachment portion 34 can be successfully detached from the lid 22.

In the first embodiment, the planned detachment portion 34 is detached in the direction of a diagonal of the label member 30. The planned detachment portion 34 and the planned remainder portion 33 are accordingly separated not from connected portions 38 therebetween (see FIG. 7) but from near a corner portion of the score line 32. Accordingly, the planned remainder portion 33 can be inhibited from being lifted and detached. In order to more surely inhibit the planned remainder portion 33 from being lifted, the score line 32 preferably extends along the boundary between the first area 36 and the second area 37 as near as possible to the boundary in substantially parallel with the boundary. The phrase "substantially parallel" means that an angle formed by the boundary and the score line is 5 degrees or less. The connected portions 38 are separated with the planned remainder portion 33 attached firmly to the lid 22 by the first area 36, and accordingly, the planned detachment portion 34 can be successfully separated from the planned remainder portion 33.

FIG. 9 illustrates a state where the planned detachment portion 34 has been detached and the planned remainder portion 33 remains attached to the lid 22. When the liquid storage container 20 (the liquid discharging head 10) is mounted to the liquid discharge apparatus 1, the character information 31 described on the planned remainder portion 33 remaining on the lid 22 is compared with information described on the liquid discharge apparatus 1. This enables a user to know the proper mounting position of the liquid storage container 20.

As illustrated in FIG. 5, the planned detachment portion 34 partially protrudes from the upper surface 22*a* of the lid 22. In many cases, the planned detachment portion 34 is detached in the direction from the protrusion side (left hand side in FIG. 5) to the side of the planned remainder portion 33 (right hand side in FIG. 5). Accordingly, the shape of the score line 32 defining the planned remainder portion 33 is preferably an L-shape illustrated in FIG. 5. Specifically, the L-shape is preferably formed such that its long side extends at an angle of 5 degrees or less with respect to the side of the label member 30 on the protrusion side, that is, the short side portion 30*c* on the protrusion side and its short side extends at an angle of 5 degrees or less with respect to the long side portions 30*b*. This enables the planned remainder portion 33 to be inhibited from being lifted when the planned detachment portion 34 is detached.

Figure 10:
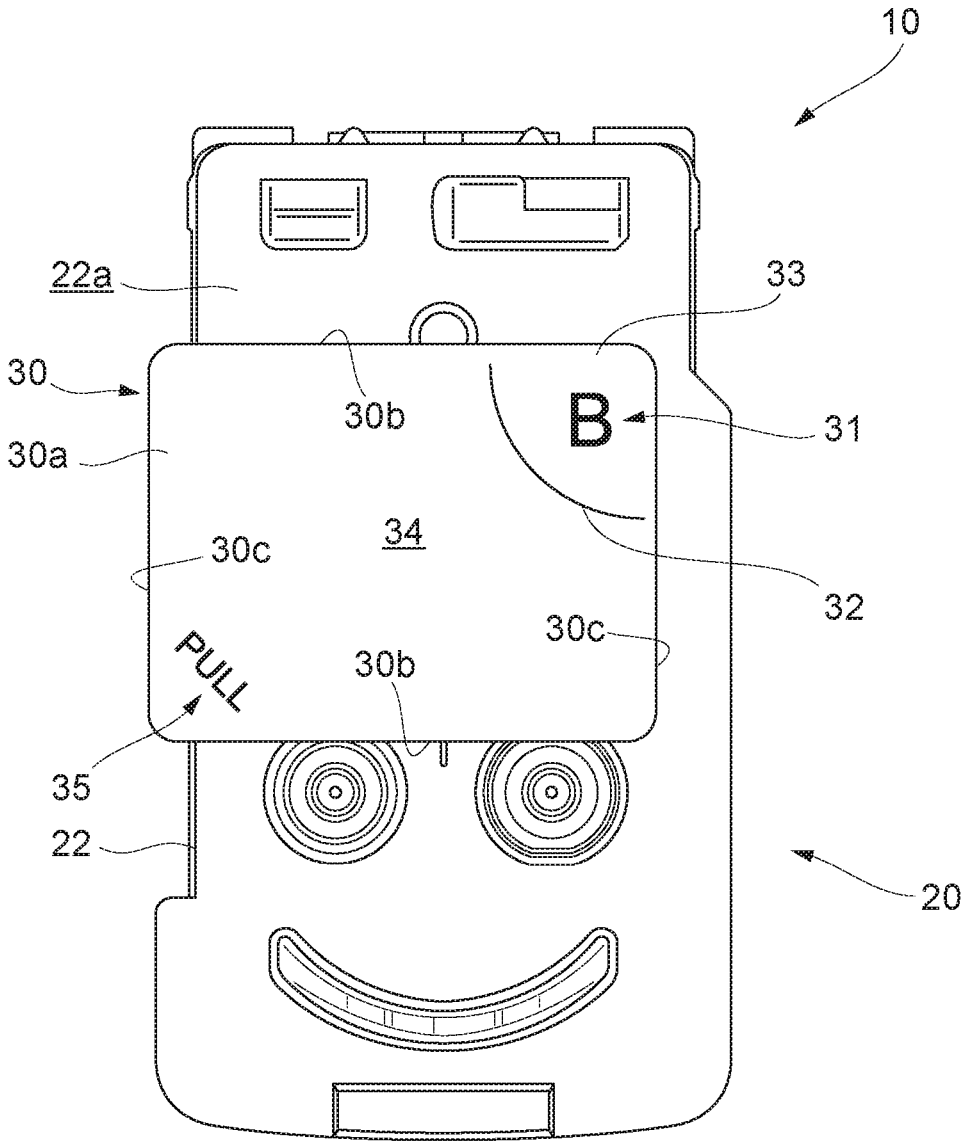
FIG. 10 is a top view of the liquid storage container.

The shape of the score line 32 is not limited to such an L-shape and may be another geometry such as an arc shape illustrated in FIG. 10. In this case, the first area 36 of the bonding face 30*d* of the planned remainder portion 33 is located inside the area surrounded by the score line 32 and accordingly has, for example, a sectorial plane shape.

Second Embodiment

Figure 11:
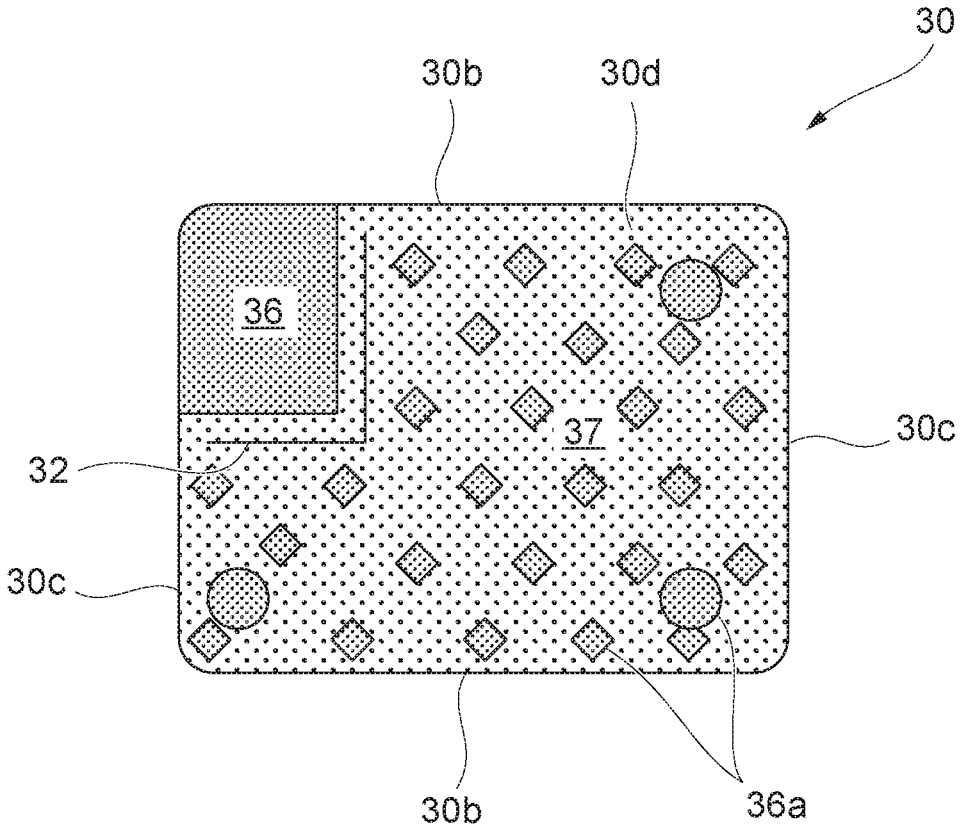
FIG. 11 is a plan view of a label member on the bonding face side.

FIG. 11 is a plan view of a label member according to a second embodiment of the present invention on the bonding face side of the label member on which the liquid storage container is to be bonded.

The second embodiment differs from the first embodiment in the bonding face 30*d* of the label member 30, particularly, the configuration of the second area 37. Specifically, the second embodiment differs from the first embodiment in that the second area 37 includes areas 36*a* (strong-adhesive-material applied areas) in which the same strong adhesive material as the strong adhesive material applied to the first area 36 is applied. The strong-adhesive-material applied areas 36*a* are dispersed in a dot pattern over the entire second area 37 including corner portions between the long side portions 30*b* and the short side portions 30*c*. Such a configuration of the bonding face 30*d* enables the label member 30 to be inhibited from warping due to an environmental change during distribution and thereby being detached and falling from the lid 22. Also in this case, the second area 37 has an average bonding strength (bonding strength per unit area) that is of such a degree that the second area 37 is readily detached by the detaching operation by a user. Other configurations are the same as in the first embodiment.

Each strong-adhesive-material applied area 36*a* in the dot pattern is formed in, for example, a square whose side is 1 mm. The strong-adhesive-material applied areas 36*a* are located so as to be spaced apart from each other at an interval of about 3 mm. The shape of some of the strong-adhesive-material applied areas 36*a* near the corner portions is, for example, a circle with a radius of 1 mm. The strong-adhesive-material applied areas 36*a* may be formed, for example, in a manner in which the same strong adhesive material as the strong adhesive material applied to the first area 36 is applied to the entire bonding face 30*d* of the label member 30, and the weak adhesive material is applied to an area other than the areas that will be the first area 36 and the strong-adhesive-material applied areas 36*a* from above the strong adhesive material. The strong-adhesive-material applied areas 36*a* are formed such that the average bonding strength of the second area 37 is less than the average bonding strength of the first area 36.

Third Embodiment

Figure 12:
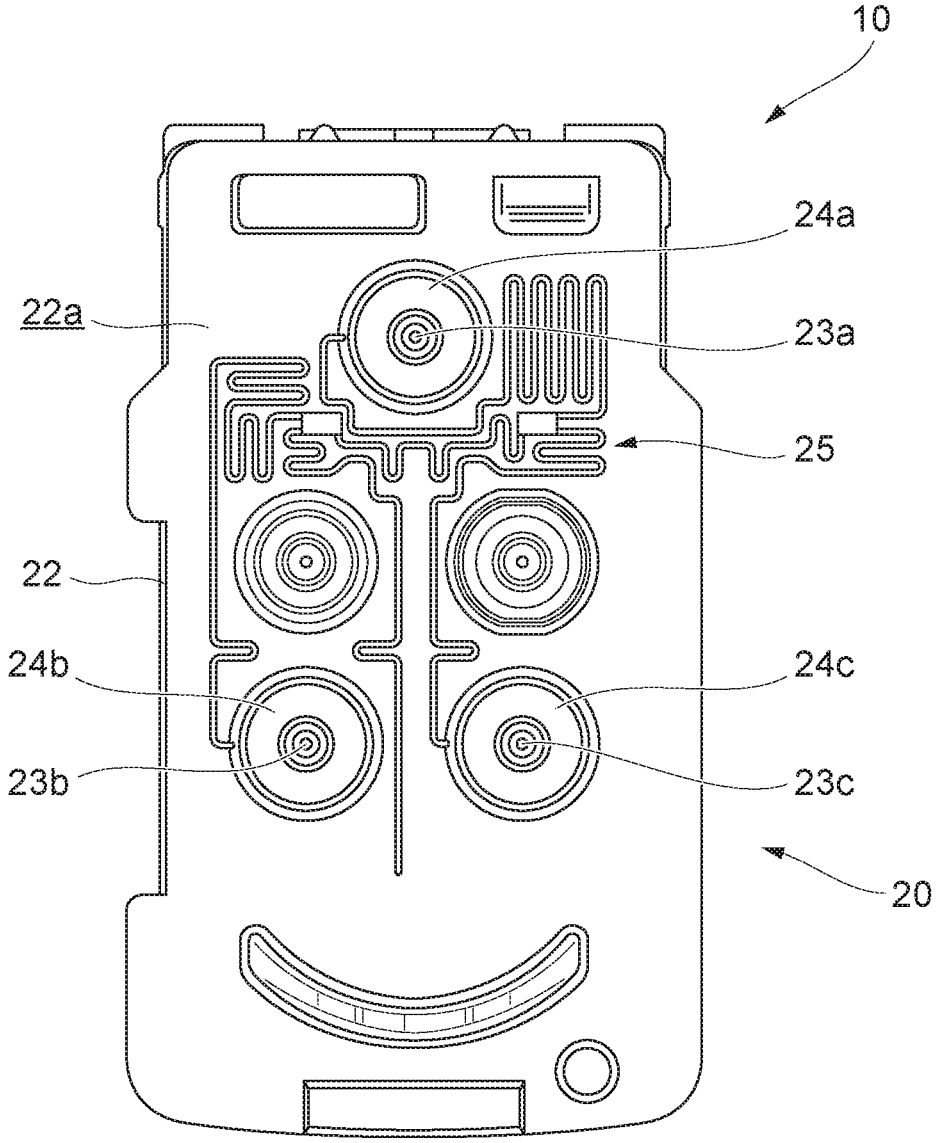
FIG. 12 is a top view of a liquid storage container.
Figure 13:
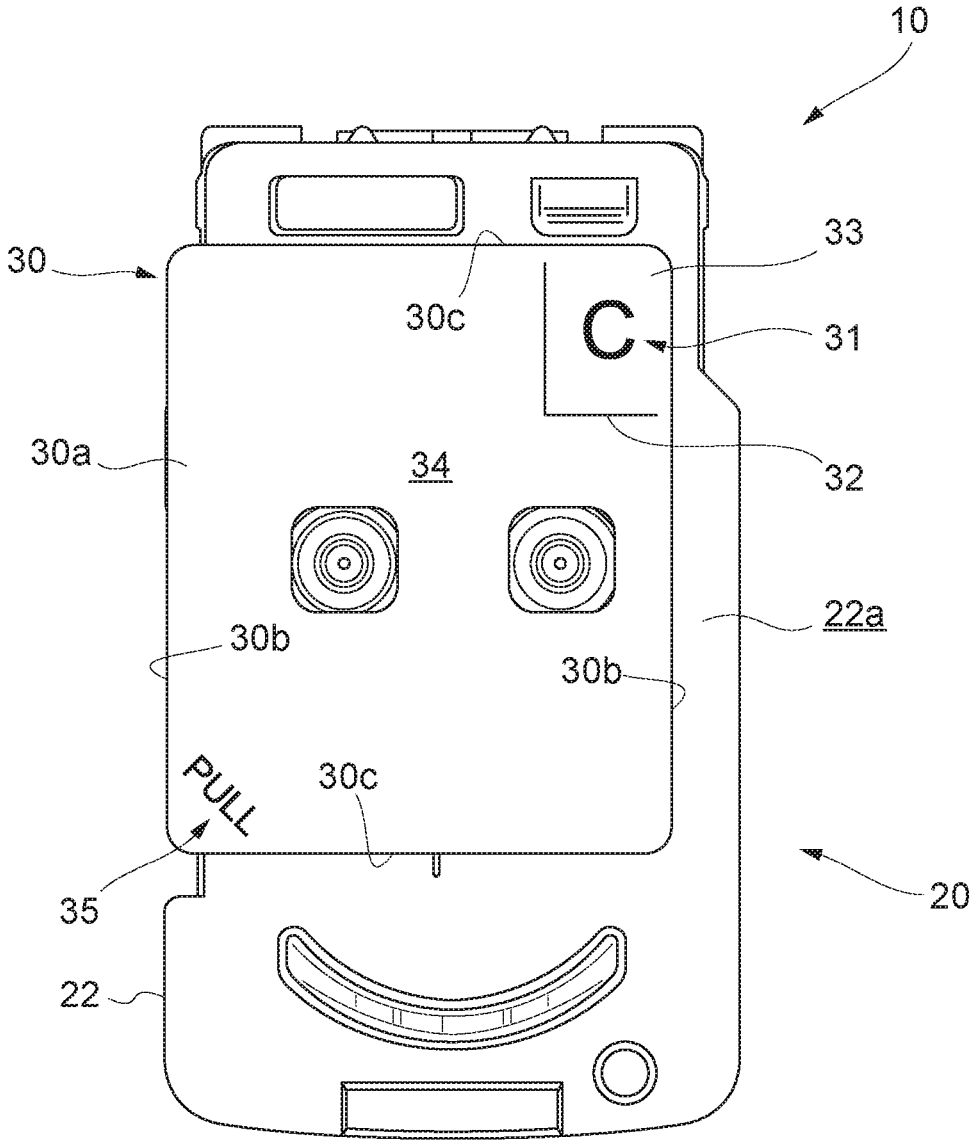
FIG. 13 is a top view of the liquid storage container during distribution.

FIG. 12 is a top view of a liquid storage container of a liquid discharging head according to a third embodiment of the present invention. FIG. 13 is a top view of the liquid storage container according to the third embodiment during distribution.

The third embodiment differs from the first and second embodiments in that the liquid discharging head 10 is configured to discharge different types of liquids, and accordingly, the liquid storage container 20 is configured to contain the different types of liquids. Specifically, in the third embodiment, three liquid supply ports 23*a* to 23*c* and three recessed portions 24*a* to 24*c* are formed in and on the upper surface 22*a* of the lid 22 so as to correspond to the different types of liquids (three types in the figures) to be contained. In the third embodiment, the size of the label member 30 to be attached is changed in accordance with the configuration of the liquid discharging head 10, and the label member 30 is attached to the lid 22 such that one of the long side portions 30*b* protrudes from the upper surface 22*a* of the lid 22. The character information 31 of "C" indicating that the liquid contained in the liquid storage container 20 is multiple-color ink is described on the information described surface 30*a* of the label member 30. The other configurations are the same as in the first and second embodiments.

Fourth Embodiment

Figure 14:
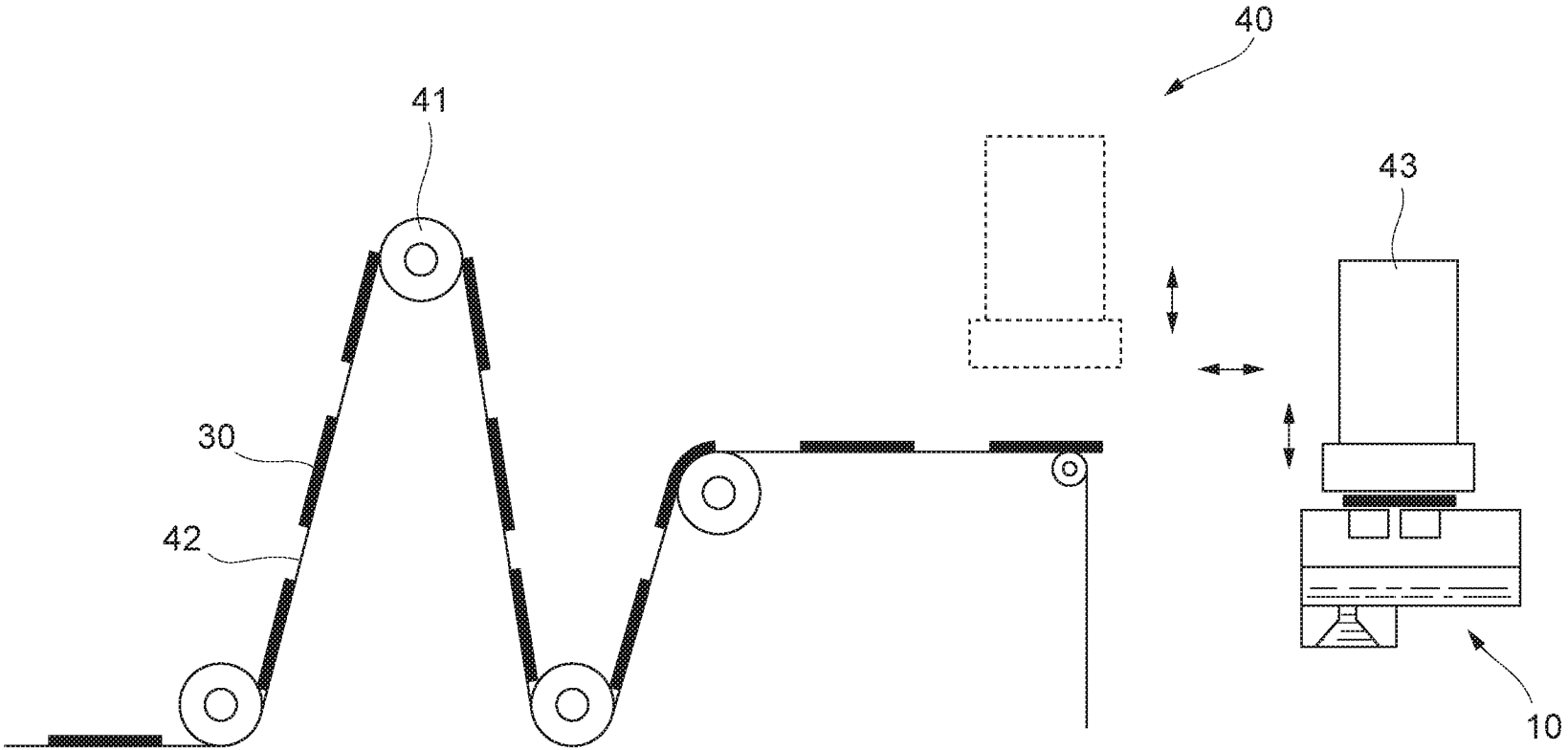
FIG. 14 is a schematic diagram illustrating the configuration of a label attaching apparatus.
Figure 15B:
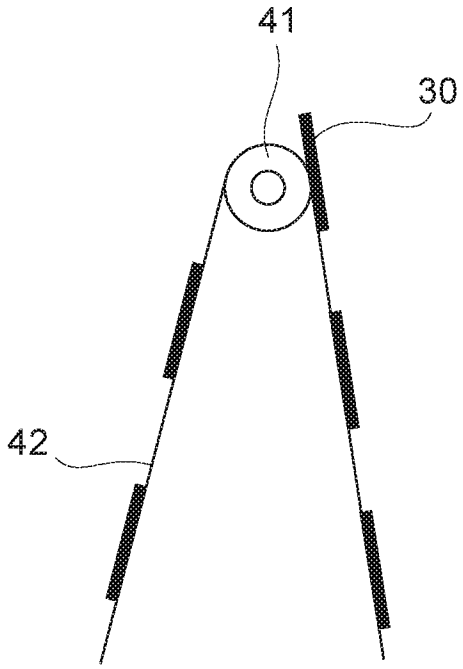
FIG. 15B is a schematic view of the label members.
Figure 15A:
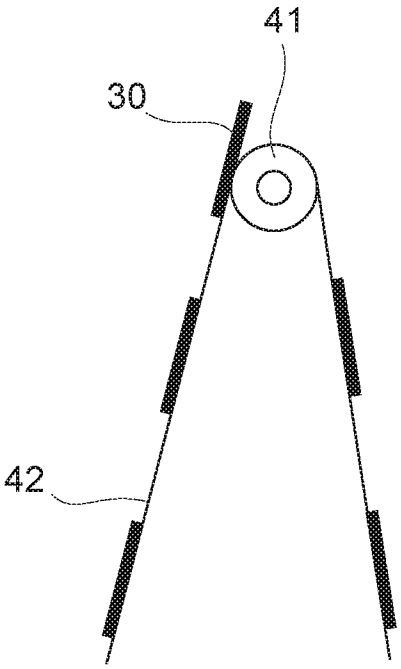
FIG. 15A is a schematic view of label members.

In the above embodiments, the second area having a relatively low bonding strength is formed on the bonding face of the label member. Accordingly, a high load is not required to detach the label member, and the label member can be readily detached. However, in the case where the second area is formed on the bonding face of the label member, a process of manufacturing the liquid discharging head, particularly a process of attaching the label member may have a problem. This problem will now be described with reference to FIG. 14, FIG. 15A, and FIG. 15B. FIG. 14 is a schematic diagram illustrating the configuration of a label attaching apparatus used in a liquid discharging head according to a fourth embodiment. FIG. 15A and FIG. 15B are schematic views of the label members when the detachment of the label members occurs in the label attaching apparatus illustrated in FIG. 14.

In a label attaching apparatus 40, the label members 30 are conveyed in the form of a web 42 by rollers 41. The label members 30 are disposed on the web 42 such that the bonding faces thereof face the web 42. When each label member 30 is conveyed to a predetermined position, the label member 30 is picked up by a pickup member 43 and attached to the liquid discharging head 10.

At this time, a tension is applied to the web 42 by the rollers 41 in order to suppress misalignment of the label members 30 with respect to the pickup member 43. When each label member 30 passes through one of the rollers 41 with the tension applied, for example as illustrated in FIG. 15A and FIG. 15B, part of the label member 30 may be detached from the web 42 depending on the position of the second area with respect to a conveyance direction. When the operation of the label attaching apparatus 40 is suspended in this state, the detached part may be exposed to air for a long time, and the bonding strength thereof may thereby be decreased. Then, even when the label member 30 is attached to the liquid storage container 20, the exposed part may be detached due to a vibration or an impact during distribution.

Figure 16:
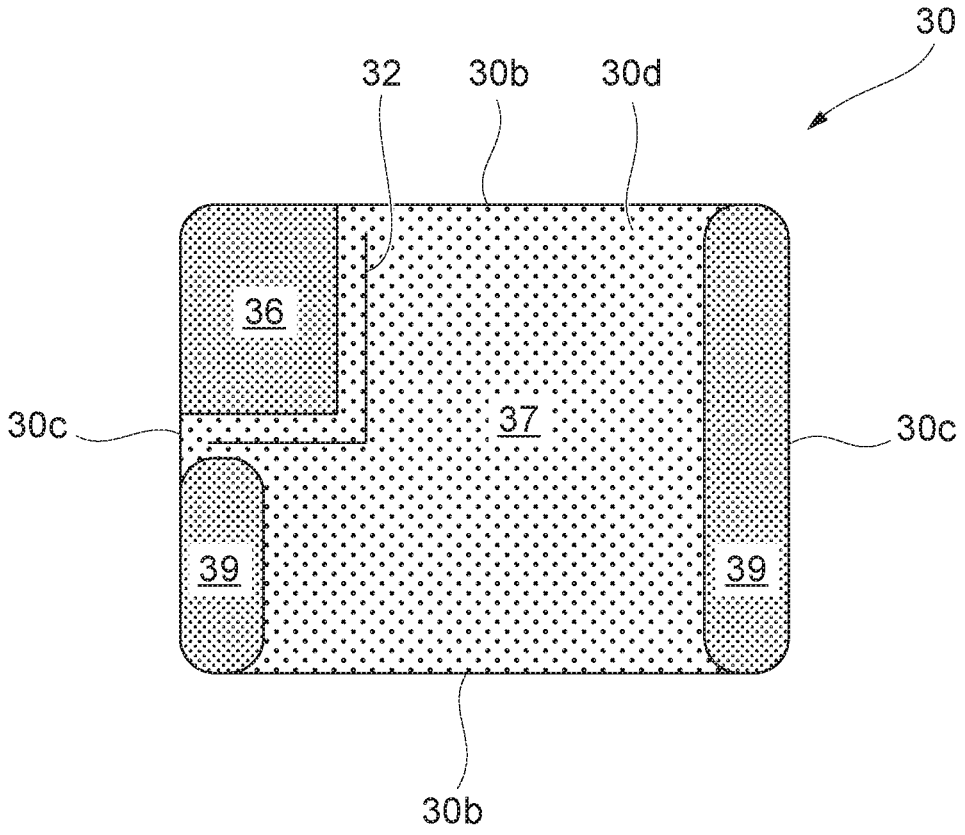
FIG. 16 is a plan view of a label member on the bonding face side.

In view of this, a first area (referred to as a third area below) different from the first area in the above embodiments is formed on the bonding face of the label member according to the fourth embodiment of the present invention. FIG. 16 is a plan view of such a label member on the bonding face side.

Referring to FIG. 16, the bonding face 30*d* of the label member 30 according to the fourth embodiment further includes third areas 39, one of which extends linearly along one short side portion 30*c* opposite to the other short side portion 30*c* adjacent to the first area 36. The third areas 39 are areas in which the same strong adhesive material as the strong adhesive material applied to the first area 36 is applied and each have a bonding strength higher than the bonding strength of the second area 37. In the case where the label member 30 is conveyed with the short side portions 30*c* being a leading end and a trailing end in the process of attaching the label member 30, the third areas 39 enable suppression of the occurrence of the above detachment and enables suppression of a decrease in the bonding strength of the label member 30.

The third areas 39 are formed on parts of the bonding face 30*d* of the label member 30 (the planned detachment portion 34), and one of the parts is held by a user when the planned detachment portion 34 is detached. The majority of the bonding face 30*d* of the planned detachment portion 34 is the second area 37 having a low bonding strength. Accordingly, even when the third areas 39 are formed, a very high load is not required to detach the planned detachment portion 34.

The bonding strength of the third areas 39 only needs to be of such a degree that the label member 30 is not detached from the web 42 when the label member 30 is conveyed as above. Accordingly, the third areas 39 are not always required to have the bonding strength equal to the bonding strength of the first area 36. That is, it suffices that an adhesive material having a bonding strength higher than the bonding strength of the weak adhesive material applied to the second area 37 is applied on the third areas 39, and the same strong adhesive material as the strong adhesive material applied on the first area 36 is not necessarily applied on the third areas 39.

Figure 17A:
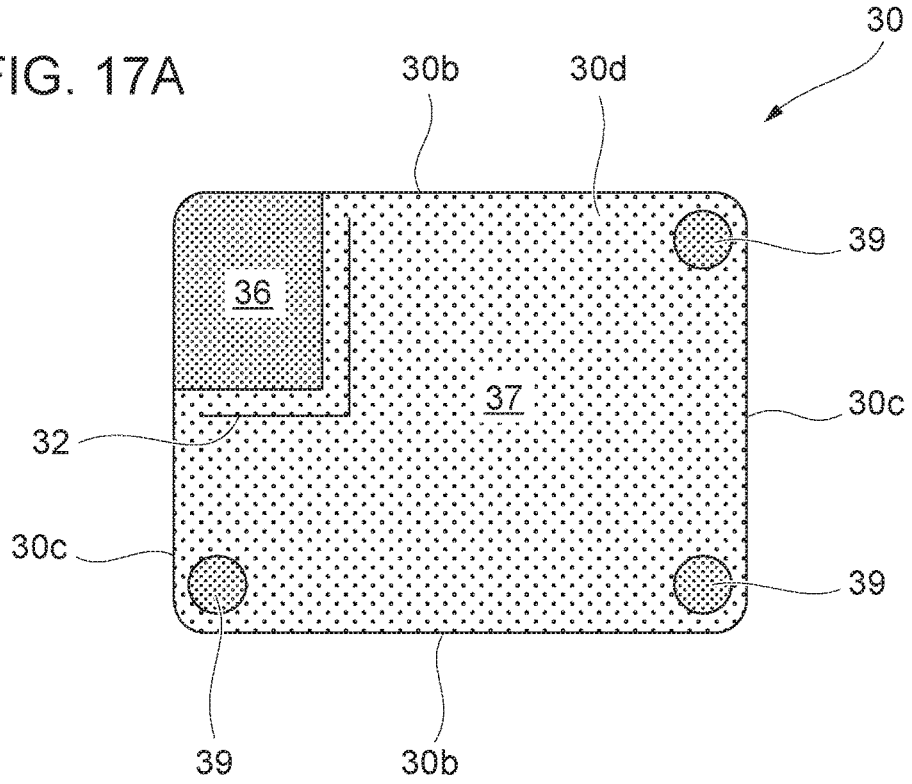
FIG. 17A is a plan view of a label member on the bonding face side.
Figure 17B:
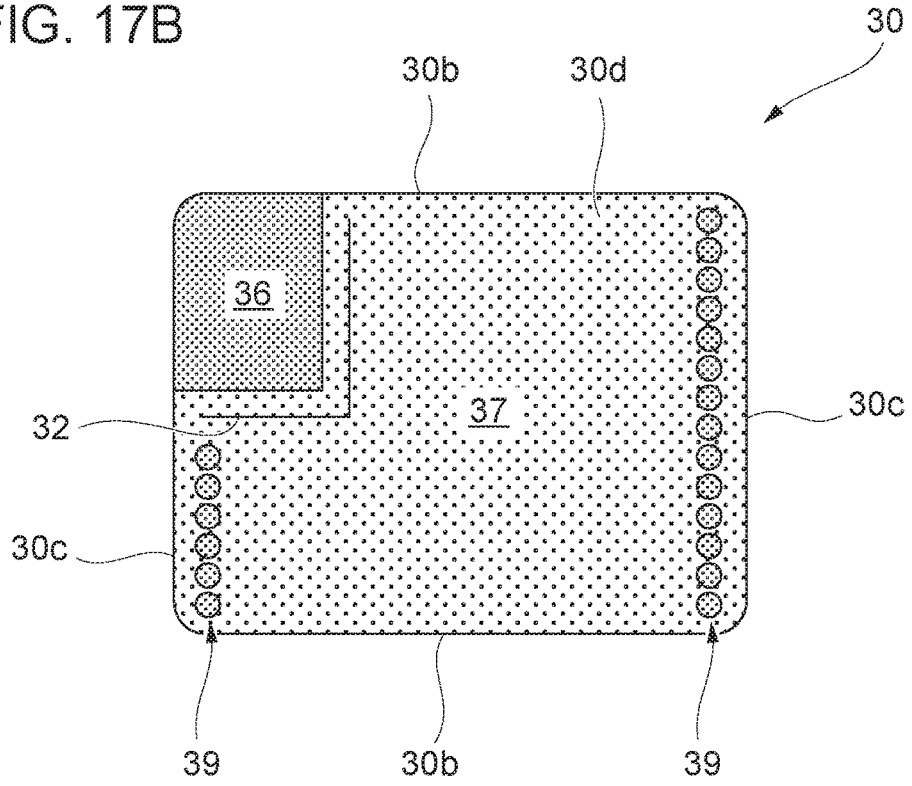
FIG. 17B is a plan view of a label member on the bonding face side.

The third areas 39 only need to suppress the detachment of the short side portions 30*c* from the web 42 when the label members 30 are conveyed as above. Accordingly, the third areas 39 do not necessarily extend linearly along the short side portions 30*c*. As illustrated in FIG. 17A, for example, a pair of the third areas 39 may be formed at both ends of one of the short side portions 30*c*. Alternatively, as illustrated in FIG. 17B, the third areas 39 may be formed in a dot pattern along the short side portions 30*c*.

In the case where the long side portions 30*b* are the leading end and the trailing end when the label member 30 is conveyed as above, attention should be paid to the fact that the third areas 39 may be formed so as not to correspond to the short side portions 30*c* but so as to correspond to the long side portions 30*b*.

In the above embodiments, the second area is formed in a manner in which the weak adhesive material having a bonding strength lower than the bonding strength of the strong adhesive material applied to the first area is applied thereon. The second area, however, may be formed in another manner provided that the average bonding strength (bonding strength per unit area) of the second area is lower than the average bonding strength of the first area. For example, the second area may be formed in a manner in which the same strong adhesive material as the strong adhesive material applied to the first area is applied to the entire bonding face of the label member, and an application agent having no bonding strength is partially applied to an area that will be the second area from above the strong adhesive material. Specifically, the second area may be formed in a manner in which the application agent having no bonding strength is applied, for example, such that the same strong adhesive material as the strong adhesive material applied to the first area is exposed in a dot pattern, a stripe pattern, or a lattice pattern.

Although the liquid storage container and the liquid discharging head that are formed integrally with each other are described by way of example in the above embodiments, the present invention can be applied to the case where the liquid storage container is a member separated from the liquid discharging head and is configured to be attachable to and detachable from the liquid discharging head. The liquid storage container to which the present invention is applied is not limited to a liquid storage container used in the liquid discharge apparatus, and the present invention can be applied to liquid storage containers used in a wide range of applications.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-214234, filed Oct. 30, 2015, which is hereby incorporated by reference herein in its entirety.

What is claimed is:

1. A liquid storage container for storing a liquid having a label member attached to a surface thereof, wherein a bonding face of the label member that is bonded to the surface includes a first area and a second area having a bonding strength lower than a bonding strength of the first area when the first area and the second area are bonded to the surface, wherein the second area of the label member covers a liquid supply port that opens through the surface and through which the liquid is supplied to an inside of the liquid storage container, and wherein a score line is formed on the label member, and the score line extends along a boundary between the first area and the second area and is formed in the second area.

2. The liquid storage container according to claim 1, wherein the score line extends at an angle of 5 degrees or less with respect to the boundary.

3. The liquid storage container according to claim 2, further comprising a print element substrate via which the liquid is discharged.

4. The liquid storage container according to claim 1, wherein an adhesive material having a relatively high bonding strength is applied to the first area, and an adhesive material having a relatively low bonding strength is applied to the second area.

5. The liquid storage container according to claim 4, wherein the adhesive material having a relatively low bonding strength is applied to one part of the second area, and the adhesive material having a relatively high bonding strength is applied to the other part of the second area.

6. The liquid storage container according to claim 5, further comprising a print element substrate via which the liquid is discharged.

7. The liquid storage container according to claim 4, further comprising a print element substrate via which the liquid is discharged.

8. The liquid storage container according to claim 1, wherein an adhesive material is applied to the first area, an application agent having no bonding strength is applied to one part of the second area, and the adhesive material is applied to the other part of the second area.

9. The liquid storage container according to claim 1, wherein a groove extending from a recessed portion formed around the liquid supply port so as to meander around the recessed portion is formed on the surface of the liquid storage container, and the label member is attached to the surface so as to surround the groove other than an end portion of the groove.

10. The liquid storage container according to claim 9, wherein the label member is attached to the surface such that a portion of the label member that is defined by the score line and whose bonding face includes the first area covers part of the groove.

11. The liquid storage container according to claim 1, wherein the label member includes a pair of opposing side portions, a portion of the label member that is defined by the score line and whose bonding face includes the first area is adjacent to one of the side portions.

12. The liquid storage container according to claim 11, wherein the label member is attached to the surface such that the other side portion protrudes from an edge portion of the surface.

13. The liquid storage container according to claim 12, wherein the score line is formed in an L-shape such that a long side thereof extends at an angle of 5 degrees or less with respect to the other side portion.

14. The liquid storage container according to claim 11, wherein the bonding face of the label member includes a third area that extends linearly along the other side portion and that has a bonding strength higher than the bonding strength of the second area.

15. The liquid storage container according to claim 11, wherein the bonding face of the label member includes a pair of third areas that are formed at both ends of the other side portion and that each have a bonding strength higher than the bonding strength of the second area.

16. The liquid storage container according to claim 11, wherein the bonding face of the label member includes plural third areas that extend along the other side portion and that each have a bonding strength higher than the bonding strength of the second area.

17. The liquid storage container according to claim 11, further comprising a print element substrate via which the liquid is discharged.

18. The liquid storage container according to claim 1, wherein information about the liquid storage container is described on a back face of the first area of the label member.

19. The liquid storage container according to claim 18, wherein the information is about the liquid contained in the liquid storage container.

20. The liquid storage container according to claim 1, further comprising a print element substrate via which the liquid is discharged.

* * * * *